US005520326A

United States Patent [19]

Schmidt

[11] Patent Number: 5,520,326

[45] Date of Patent: May 28, 1996

[54] SYSTEM FOR ALERTING MAIL DISTRIBUTORS

[76] Inventor: Kathy K. Schmidt, 813 N. Granite St., Gilbert, Ariz. 85234

[21] Appl. No.: 320,523

[22] Filed: Oct. 11, 1994

[51] Int. Cl.[6] ..... B65D 91/00

[52] U.S. Cl. ..... 232/34; 232/37; 40/606

[58] Field of Search ..... 232/33, 34, 37, 232/41 R; 40/506, 606

[56] References Cited

U.S. PATENT DOCUMENTS

| | | | |
|---|---|---|---|
| 415,746 | 11/1889 | Taylor | 232/34 |
| 609,604 | 8/1898 | Zuber | 232/34 |
| 636,992 | 11/1899 | Hoagland et al. | 232/37 |
| 703,920 | 7/1902 | Herd | 232/34 |
| 720,279 | 2/1903 | Norton | 232/34 |
| 750,519 | 1/1904 | Booth | 232/34 |
| 757,513 | 4/1904 | Sturgis et al. | 232/34 |
| 2,801,046 | 7/1957 | Mirkin | 232/34 |
| 2,927,726 | 3/1960 | Workman | 232/34 |
| 5,402,591 | 4/1995 | Lee | 40/584 |

*Primary Examiner*—Michael J. Milano

*Attorney, Agent, or Firm*—Harry M. Weiss; Jeffrey D. Moy; Harry M. Weiss & Associates

[57] ABSTRACT

A system for alerting mail distributors to a potential message (such as that all the current mail has been forwarded) when attempting to deliver mail to a mail receptacle. A device is provided which may be entirely located within such mail receptacle, which device permits the positioning of both alerting means and message means in a position demanding attention by such mail distributor. Alerting is accomplished by an enhanced sort of "miniature stop sign" and messaging is provided by a slotted holder for holding a replaceable message viewable through a transparent face of the message holder. Appropriate positioning of the alerting system within the mail receptacle is accomplished by a pair of spring-loaded extendible rods which may be retracted by the user to place the whole alerting system within the mail receptacle and then releasing the rods for compression contact with the inner walls of the mail receptacle.

16 Claims, 1 Drawing Sheet

SYSTEM FOR ALERTING MAIL DISTRIBUTORS

BACKGROUND OF THE INVENTION

1. Field of the Invention

This invention relates generally to a system for alerting mail distributors when attempting to deliver mail to a mail receptacle. More specifically, it relates to a system which not only alerts the mail distributor to a potential message (such as that all the current mail has been forwarded), but which also presents any such message to the mail distributor, e.g., when the mail distributor has opened the mail receptacle. Even more specifically, it provides a device, which may be entirely located within such mail receptacle, which device permits the positioning of both alerting means and message means in a position demanding attention by such mail distributor.

2. Description of the Prior Art

For many years, users of mail boxes and similar receptacles have suffered potential problems with their mail, and with mail carriers and other mail distributors, whenever there has been some change necessary in the normal delivery pattern.

Typically, for example, a user may wish to forward the user's mail to a new address temporarily, as is often done by those taking an extended trip or vacation, or by those having a new temporary seasonal address. Frequently, despite normal care by those in the mail handling business, some mail will fail to be forwarded and will be deposited in the mail receptacle at the old address. This creates an almost insurmountable problem with important mail in that often no one is checking the old-address mail receptacle on behalf of the user; and such checking is itself often very bothersome.

Also typically, for example, a user may wish the user's mail to be kept "on hold" for a temporary period at a post office and not deposited in the user's mail receptacle, where such mail might almost certainly overfill the user's mail receptacle during the user's absence. Frequently, also, despite normal care by those in the mail handling business, some mail will fail to be "held" and will be deposited in the mail receptacle at the old address.

Some users have attempted to avoid problems like those just mentioned by writing a brief note to the mail distributor and leaving the note in the mail receptacle. However, such notes often go unnoticed and are rapidly covered over with mail. A message or flag external to the mail receptacle might help avoid unwanted mail delivery but would also introduce a huge negative factor in the loss of privacy and in the potential "invitation" to criminals in making public a user's absence (just as would an overflowing and unemptied mail receptacle). Furthermore, any external notice might be disturbed by vandals.

Thus, for a considerable time period there has existed a need, to which the present invention is addressed, for a workable and efficient system for alerting mail distributors to important messages and reminders, e.g., those requiring non-delivery of mail to the mail receptacle. The need is for a system which addresses the above-mentioned and other problems in an efficient, cost-effective, combinatorial, creative, and operational manner. Nowhere, until the present invention, has there been provided such an efficient and workable system.

OBJECTS OF THE INVENTION

Accordingly, it is an object of this invention to provide an improved system for alerting mail distributors to important messages and reminders.

An additional object of this invention is to provide a device and elements thereof which will efficiently overcome the above-mentioned and other mail problems presented to a user who wishes mail to be forwarded or "held" and not delivered.

Another object is to provide an improved system of alerting mail distributors. Still another object is to provide an improved system of presenting appropriate messages to mail distributors. Yet another object is to provide an improved system for most efficiently positioning alerting and messaging elements. Even another object is to provide an improved such system usable with most sizes and types of mail receptacles.

It is a further object of this invention to provide, in a unitary device, in creative combination, multiple elements and functions which together overcome the problems presented by the prior art.

SUMMARY OF THE INVENTION

According to the foregoing objectives, this invention describes an improved system and device for alerting mail distributors to important messages and information from the user/owner when such mail distributors are distributing mail to such user's mail receptacle, which system provides, in combination, elements and functions fulfilling all of said objectives.

This invention provides an alerting system for use with mail boxes, post office boxes, and similar mail receptacles, comprising: holding means for replaceably holding message means for viewing by mail distributors when distributing mail to a such receptacle; alerting means for demanding the attention of such mail distributors when distributing mail to a such receptacle; and positioning means structured and arranged for positioning such holding means and such alerting means within such receptacle in position for alerting such mail distributors and presenting any such message for viewing.

This invention further provides such alerting system wherein such alerting means comprises readable indicia for the word "STOP" situate on a hexagonal, substantially-red-colored background. And it provides such system wherein such holding means is substantially-centrally positioned on such background; and further wherein such holding means comprises slot means for receiving a flat message means, such slot means comprising transparent-face means enabling viewing of any such message means. Additionally, this invention provides such an alerting system including message means for indicating a message comprising replaceable indicia; and, further, wherein such message means is flat; and, further, wherein the background color of such message means bearing such replaceable indicia is substantially white.

Moreover, this invention provides such an alerting system wherein such alerting means comprises a white border around such hexagonal, substantially-red-colored background. And this invention further provides such an alerting system wherein such holding means comprises: slot means for receiving a message note, such slot means comprising transparent-face means enabling viewing of any such message note.

Also, this invention provides such an alerting system wherein such positioning means comprises extendible rod means for forming a compression contact with a pair of walls of a such mail receptacle; and, further, wherein such positioning means comprises structural means for providing a fixed spacial relationship between such extendible rod means and such alerting means. Further provided by this invention is such an alerting system including a mail receptacle of the type openable by mail distributors.

In addition, this invention provides a message-alerting system comprising: alerting means for demanding attention; and attached to such alerting means, positioning means for positioning such alerting means between a pair of walls of a walled chamber; wherein such alerting means comprises readable indicia for the word "STOP" situate on a hexagonal, substantially-red-colored background; and wherein such positioning means comprises extendible rod means for forming a compression contact with a such pair of walls of a such walled chamber.

This invention also provides an alerting system for use with mail boxes, post office boxes, and similar mail receptacles, comprising: message means for indicating a message comprising replaceable indicia, such message means comprising a flat, light-colored, rectangular element containing dark-colored such indicia; holding means for replaceably holding such message means for viewing by mail distributors when distributing mail to a such receptacle, wherein such holding means comprises slot means for receiving such flat message means, such slot means comprising transparent-face means enabling viewing of such message means; alerting means for demanding the attention of such mail distributors when distributing mail to a such receptacle, wherein such alerting means comprises readable indicia for the word "STOP" situate on a hexagonal, substantially-red-colored background, and wherein such alerting means comprises a white border around such hexagonal, substantially-red-colored background; wherein such holding means is substantially-centrally positioned on such substantially-red-colored background; and positioning means structured and arranged for positioning such holding means and such alerting means within such receptacle in position for alerting such mail distributors and presenting any such message for viewing, wherein such positioning means comprises extendible rod means for forming a compression contact with a pair of walls of a such mail receptacle, and wherein such positioning means comprises structural means for providing a fixed spacial relationship between such extendible rod means and such alerting means.

Further provided is such an alerting system wherein such extendible rod means comprises: cylindrical housing means on the opposed side of such structural means to such readable indicia for such word "STOP" and parallel longitudinally to such word; mounted in such cylindrical housing means, compression spring means pushing outwardly on a pair of extendible rods, extending from such cylindrical housing means; at the outer end of each such extendible rod, elastic-tip means; and adjacent the outer end of each such extendible rod, handle means for use in the compressing of a such extendible rod against such compression spring means to shorten such extendible rod means.

DETAILED DESCRIPTION

Figure 1:
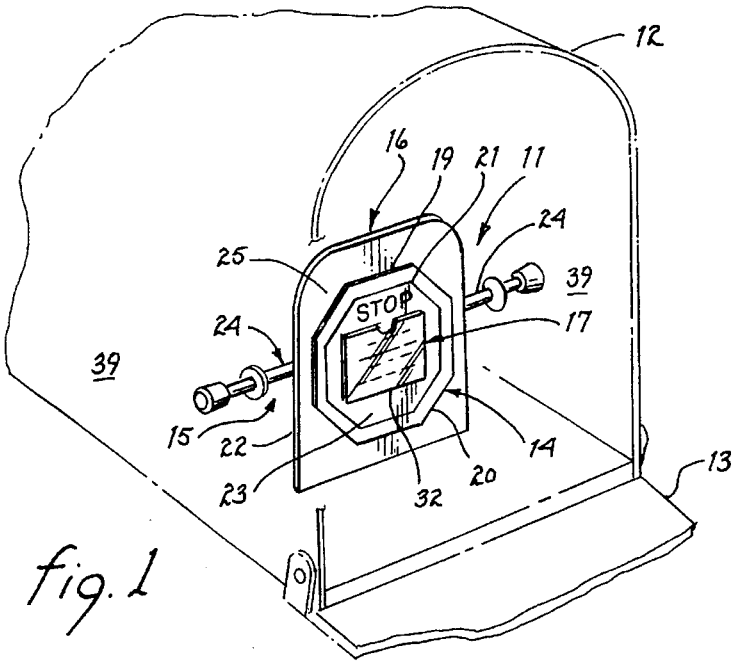
FIG. 1 is a pictorial illustration, with partial sections, of a preferred embodiment of the system of the present invention, illustrating its use with one typical type of mail receptacle.

FIG. 1 shows a preferred embodiment of the alerting system 11 of the present invention in use with a mail receptacle 12 of the mailbox type. The mail receptacle door 13 is shown open, as it would be when a mail distributor (a mail deliverer for the type of mailbox shown) opens mail receptacle door 13 and prepares to deliver mail into mail receptacle 12. The elements of the illustrated preferred embodiment of alerting system 11 are alerting means 14, positioning means 15 (which includes structural means 16), holding means 17, and message means 18. The elements of the preferred embodiment of alerting means 14 are outer hexagonal design 19 (shown in the preferred embodiment as hexagonal structure 19, but which may also comprise a hexagonal design artistically placed upon, e.g., structural means 16), inner hexagonal design 20 (forming a sort of miniature stop-sign in appearance), and readable indicia for the word "STOP" 21. In the preferred embodiment, certain colors and placements thereof enhance the attention-demanding performance of alerting means 14. Preferably, the areas 22 between outer hexagonal design 19 and inner hexagonal design 20 should be substantially white in color, and the viewable areas 23 within inner hexagonal design should be substantially red in color. The readable indicia for the word "STOP" 21 should be black or dark in color.

Figure 2:
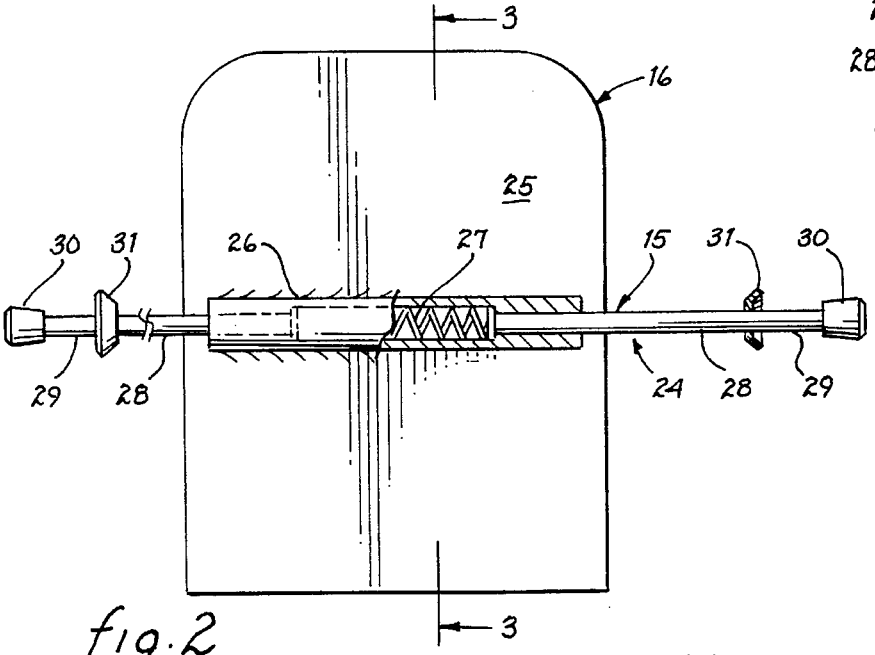
FIG. 2 is a partial rear view of the preferred embodiment of FIG. 1, from just inside the back of the mail receptacle and showing the preferred positioning means in partial section.
Figure 3:
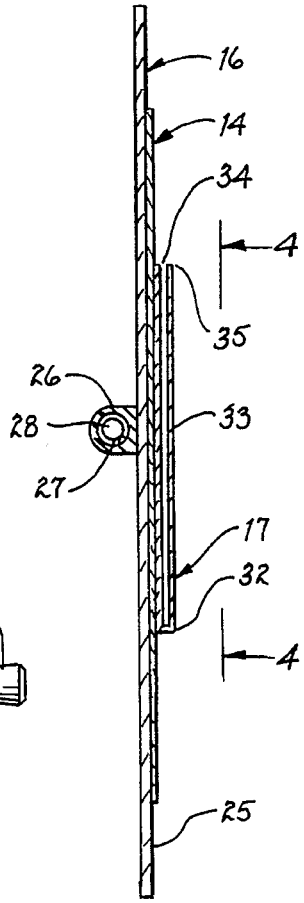
FIG. 3 is a partial sectional side view through the section 3—3 of FIG. 2, further illustrating the portions of the preferred embodiment as located within the mail receptacle.

The elements of the preferred embodiment of the positioning means 15 (see FIGS. 1–3) are structural means 16 and extendible rod means 24. Preferably, structural means 16 consists essentially of plate 25. Preferably, the elements of extendible rod means 24 are: cylindrical housing means 26 attached to and on the opposed side of plate 25 (of structural means 16) from the readable indicia for the word "STOP" 21 and parallel longitudinally to the readable indicia for the word "STOP" 21; mounted in cylindrical housing means 26, compression spring means 27 pushing outwardly on a pair of extendible rods 28, extending from cylindrical housing means 26; at the outer end 29 of each extendible rod 28, elastic-tip means 30; and adjacent the outer end 29 of each extendible rod 28, handle means 31 for use in the compressing of an extendible rod 28 against compression spring means 27 to shorten extendible rod means 24 for ease of placement within mail receptacle 12.

Figure 4:
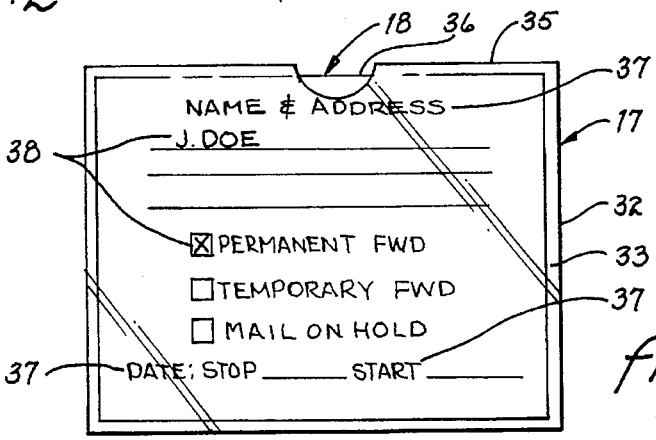
FIG. 4 is a partial sectional front view through the section 4–4 further illustrating the holding means and message means of the preferred embodiment of the present invention.

The elements of the preferred embodiment of holding means 17 (shown as rectangular) (see FIGS. 1, 3, and 4) are slot means 32 for receiving a message means 18 (shown as flat) including transparent-face means 33 enabling viewing of a message means 18 Slot 34 is located along the upper edge 35 of holding means 17. Holding means 17 is preferably located so as to be substantially-centrally positioned (as shown) within area 23 (the substantially red colored area within inner hexagonal design 20). The elements of the preferred embodiment of message means 18 (see FIGS. 1 and 4) are a flat, light-colored, rectangular element 36 containing thereon dark-colored indicia 37, including replaceable indicia 38. Shown in FIG. 4 are sample preferred contents for the indicia 37 constituting the message of message means 18. As shown, a user would replaceably add to element 36, as in pencil, the user's name and address and the user would further check the appropriate box on element 36 to indicate to a mail distributor the mail status; and the user might further add a stop-mail and start-mail date to give further information to a mail distributor.

In using the instant invention in preferred ways, a user who wishes to alert and give information to the person opening the door to a walled chamber like mail receptacle 12 will appropriately fill in message element 36, place element 36 in slot 34 into slot means 32 with the message showing through transparent-face means 33. Then the user will grasp alerting system 11 by the pair of handle means 31, using said pair of handle means 31 to compress compression spring means 27 to shorten the distance between rod outer ends 29 as much as necessary to place alerting system 11 within the walled chamber like mail receptacle 12 and appropriately release handle means 31 so that the pair of elastic tip means 30 compress (using the forces provided by compression spring means 27) against a pair of walls 39 to place alerting means 14 and message means 18 in an upright position for viewing. When a person then opens the door 13, the look of the red "miniature stop-sign" (with the word "STOP") surrounded by a white border and placed in viewable position will normally alert that person enough to pause and read the message of message means 18.

It is especially pointed out that the alerting system 11 of this invention depends upon the previous training of most persons to become alerted when faced with elements of a stop sign, i.e., red color, the word "STOP" and a hexagonal design. A white or very light hexagonal border around such sign elements further enhances their being noticed. Using the present invention, such elements may be positioned internally at a selected position to be most effective in alerting a person opening such chamber so that a message will be read and not ignored.

Further advantages of applicant's invention will be apparent to those skilled in the art from the above descriptions and the below claims.

What is claimed is:

1. An alerting system for use with mail boxes, post office boxes, and similar mail receptacles, comprising:

a. holding means for replaceable holding a message for viewing by mail distributors when distributing mail to one of said receptacles;

b. alerting means for demanding the attention of said mail distributors when distributing mail to said one of said receptacles; and c. position means structured and arranged for positioning said holding means and said alerting means within said one of said receptacles in position for alerting said mail distributors and presenting any said message for viewing, said positioning means comprises extendible rod means for forming a compression contact with a pair of walls of said of said receptacles.

2. The system of claim 1 wherein said alerting means comprises readable indicia for the word "STOP" situate on a hexagonal, substantially-red-colored background.

3. The system of claim 2 wherein said holding means is substantially-centrally positioned on said background.

4. The system of claim 1 wherein said holding means comprises slot for receiving a flat message, said slot means comprising transparent-face means for enabling viewing of said flat message.

5. The system of claim 1 wherein said message comprising replaceable indicia.

6. The system of claim 5 wherein said message is flat.

7. The system of claim 5 wherein a background color of said message bearing said replaceable indicia is substantially white.

8. The system of claim 2 wherein said alerting means comprises a white border around said hexagonal, substantially-red-colored background.

9. The system of claim 1 wherein said holding means comprises:

a. slot means for receiving said message, said slot means comprising transparent-face means for enabling viewing of said message.

10. The system of claim 1 wherein said positioning means comprises structural means for providing a fixed spacial relationship between said extendible rod means and said alerting means.

11. An alerting system for use with mail boxes, post office boxes, and similar mail receptacles, comprising:

a. holding means for replaceably holding a message for viewing by mail distributors when distributing mail to one of said receptacles;

b. alerting means for demanding the attention of said mail distributors when distributing mail to said one of said receptacles; and c. positioning means structured and arranged for positioning said holding means and said alerting means within said one of said receptacles in position for alerting said mail distributors and presenting any said message for viewing, said alerting means comprises readable indicia for the word "STOP" situate on a hexagonal, substantially red-colored-background, said holding means is substantially-centrally positioned on said background.

12. The system of claim 11 wherein said message comprising replaceable indicia.

13. The system of claim 11 wherein said one of said receptacles being of the type openable by mail distributors.

14. A mail-status alerting system comprising:

a. a mail receptacle of the type openable by mail distributors;

b. message means for indicating a message comprising replaceable indicia;

c. holding means for replaceably holding said message means viewable by said mail distributors when distributing mail to said receptacle;

d. alerting means for demanding the attention of said mail distributors when distributing mail to said receptacle; and e. positioning means for positioning said holding means and said alerting means within said receptacle;

f. said alerting system being structured and arranged for
   i. alerting said mail distributors when distributing mail to said receptacle; and
   ii. indicating said message to said mail distributors when distributing mail to said receptacle, g. said alerting means comprises readable indicia for the word "STOP" situate on a hexagonal, substantially-red-colored background;

h. said holding means is substantially-centrally positioned on said background.

15. An alerting system for use with mail boxes, post office boxes, and similar mail receptacles, comprising:

a. message means for indicating a message comprising replaceable indicia, i. said message means comprising a flat, light-colored, rectangular element containing dark-colored said indicia;

b. holding means for replaceably holding said message means for viewing by mail distributors when distributing mail to one of said receptacles, i. wherein said holding means comprises slot means for receiving said flat element, said slot means comprising transparent-face means for enabling viewing of said message means;

c. alerting means for demanding the attention of said mail distributors when distributing mail to one of said receptacles, i. wherein said alerting means comprises readable indicia for the word "STOP" situate on a hexagonal, substantially-red-colored background, and ii. wherein said alerting means comprises a white border around said hexagonal, substantially-red-colored background;

d. wherein said holding means is substantially-centrally positioned on said substantially-red-colored background; and e. positioning means structured and arranged for positioning said holding means and said alerting means within said receptacle in position for alerting said mail distributors and presenting any said message for viewing, i. wherein said positioning means comprises extendible rod means for forming a compression contact with a pair of walls of one of said mail receptacles, and ii. wherein said positioning means comprises structural means for providing a fixed spacial relationship between said extendible rod means and said alerting means.

16. The system of claim 15 wherein said extendible rod means comprises:

a. cylindrical housing means on the opposed side of said structural means to said readable indicia for said word "STOP" and parallel longitudinally to said word;

b. compression spring means mounted in said cylindrical housing means for pushing outwardly on a pair of extendible rods extending from said cylindrical housing means;

c. an elastic-tip located at the outer end of each said extendible rod; and d. handle means adjacent the outer end of each said extendible rod for use in the compressing of said extendible rod against said compression spring means to shorten said extendible rod means.

* * * * *